US007264143B2

(12) United States Patent
Khubani et al.

(10) Patent No.: US 7,264,143 B2
(45) Date of Patent: Sep. 4, 2007

(54) AEROSOL PRODUCT DISPENSER

(75) Inventors: Anand Khubani, Towaco, NJ (US); Aaron Szymanski, Thomaston, CT (US)

(73) Assignee: Ideavillage Products Corp., Fairfield, NJ (US)

( * ) Notice: Subject to any disclaimer, the term of this patent is extended or adjusted under 35 U.S.C. 154(b) by 235 days.

(21) Appl. No.: 10/989,883

(22) Filed: Nov. 16, 2004

(65) Prior Publication Data

US 2006/0011662 A1 Jan. 19, 2006

Related U.S. Application Data

(60) Provisional application No. 60/589,483, filed on Jul. 19, 2004.

(51) Int. Cl.
*G01F 11/10* (2006.01)
*B05B 7/02* (2006.01)

(52) U.S. Cl. ..... 222/325; 222/79; 222/182; 222/471; 222/402.13; 222/402.15; 239/526

(58) Field of Classification Search ..... 222/79, 222/402.13, 402.15, 470, 471, 472, 473, 222/113, 183, 325, 182, 131; 239/526, 525, 239/337
See application file for complete search history.

(56) References Cited

U.S. PATENT DOCUMENTS 3,730,390 A * 5/1973 Adrian et al. ..... 222/79
4,186,851 A * 2/1980 Cantor ..... 222/113
4,301,946 A * 11/1981 Goldin et al. ..... 222/113
4,432,474 A 2/1984 Hutchinson et al.
D283,801 S 5/1986 Brown et al.
D287,394 S 12/1986 Yamamoto
4,742,963 A 5/1988 Marvaldi
4,805,812 A 2/1989 Brody
5,086,954 A 2/1992 Brody
5,323,937 A 6/1994 Brody
5,397,029 A * 3/1995 West ..... 222/79
5,473,501 A * 12/1995 Claypool ..... 361/232
5,581,898 A * 12/1996 Thummel ..... 42/117
5,629,679 A * 5/1997 Cranford et al. ..... 340/574
5,819,985 A 10/1998 Brody
5,992,707 A 11/1999 Gaichuk
6,402,058 B2 6/2002 Kaneko et al.
6,922,931 B2 * 8/2005 Bauer et al. ..... 42/1.08

* cited by examiner

*Primary Examiner*—Kevin Shaver
*Assistant Examiner*—Stephanie E. Tyler
(74) *Attorney, Agent, or Firm*—Robert L. Epstein; Epstein Drangel Bazerman & James, LLP

(57) ABSTRACT

The apparatus is designed to dispense an aerosol product from a pressurized cylindrical cannister having a depressible nozzle at one end. The dispenser is pistol-shaped, formed of a generally cylindrical body and a downwardly extending handle with a trigger. The body defines an elongated recess adapted to receive and engage the cannister, with the nozzle situated substantially along the axis of the body. The dispenser body has a nose part moveably mounted in the front end. Means are provided for connecting the trigger to move the nose part relative to the body to depress the canister nozzle such that the product is released through an opening in the nose part.

31 Claims, 5 Drawing Sheets

4
C
D
12
14
16
18
20
22
24
26
28
30
32
34
36
38
40
44
48
50
52
54
56
58
60
64
68
70

FIG. 11
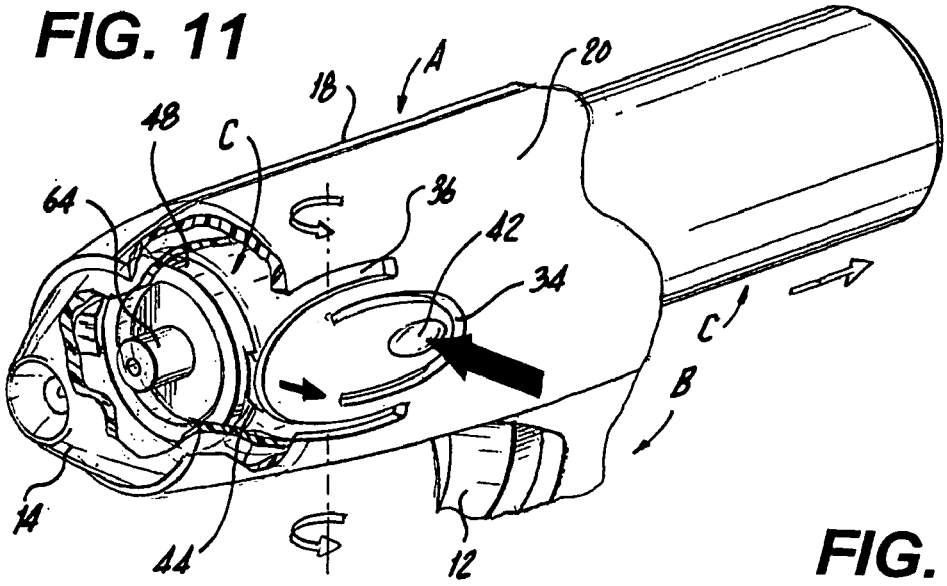
FIG. 12
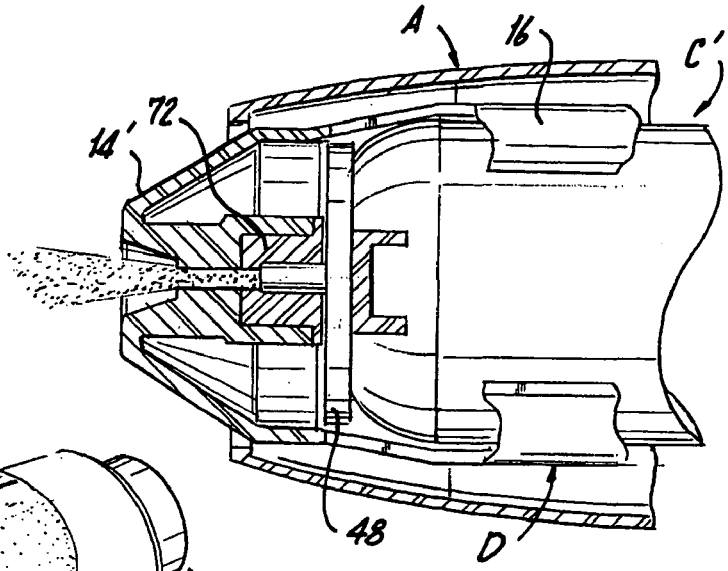
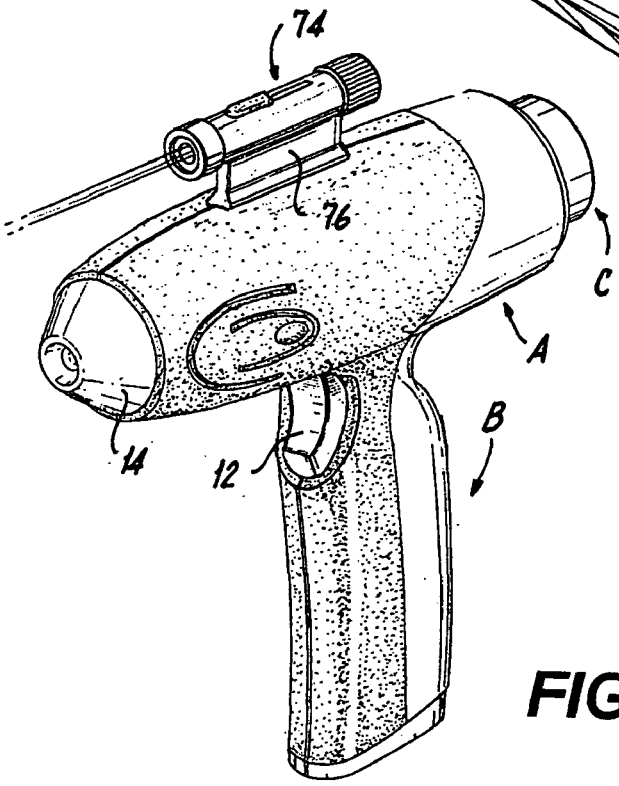
FIG. 13

AEROSOL PRODUCT DISPENSER

CROSS-REFERENCE TO RELATED APPLICATIONS

This application is based upon Provisional Application Ser. No. 60/589,483, filed Jul. 19, 2004 and priority thereon is hereby claimed

STATEMENT REGARDING FEDERALLY SPONSORED RESEARCH OR DEVELOPMENT

Not Applicable

REFERENCE TO A "SEQUENCE LISTING", A TABLE, OR A COMPUTER PROGRAM LISTING APPENDIX SUBMITTED ON COMPACT DISC

Not Applicable

BACKGROUND OF THE INVENTION

1. Field of the Invention

The present invention relates to dispensers for spraying aerosol products supplied in pressurized canisters and more particularly to a pistol-shaped dispenser that receives the canister and is trigger actuated to release the product spray in a direction along the axis of the canister.

2. Description of Prior Art Including Information Disclosed Under 37 CFR 1.97 and 1.98

Many types of dispensers are known for dispensing aerosol products from pressurized canisters that have a top mounted axial stem which is depressible to release the product spray. For example: U.S. Pat. No. 4,805,812, issued Feb. 21, 1989 to Brody; U.S. Pat. No. 5,086,954, issued Feb. 11, 1992 to Brody; U.S. Pat. No. 5,819,985, issued Oct. 13, 1998 to Brody; U.S. Pat. No. 5,323,937, issued Jun. 28, 1994 to Brody; U.S. Pat. No. 4,432,474, issued Feb. 21, 1984 to Hutchinson et al.; U.S. Pat. No. 5,992,707, issued Nov. 30, 1999 to Galchuk; Pat. No. Des. 283,801, issued May 13, 1986 to Brown; Pat. No. Des. 287,394, issued Dec. 23, 1986 to Yamamoto U.S. Pat. No. 6,402,058, issued Jun. 11, 2002 to Kaneko and U.S. Pat. No. 4,742,963, issued May 10, 1988 to Marvaldi.

All of those dispensers are designed to release the product in a direction that is perpendicular to the axis of the canister. Since the stem is axially extending from the top of the canister, either a nozzle mounted on the stem or the dispenser itself must contain structure that redirects the product spray 90 degrees from the stem. Redirecting the spray in that manner diminishes the energy of the spray and hence the distance and spread of the spray.

Dispensers of that type are cumbersome because the canister is not received within the body of the dispenser but instead hangs down from the bottom of the dispenser. The dispensers are therefore not properly balanced, making them difficult to manipulate. They may require both hands to operate. Further, those dispensers tend not to be aesthetically pleasing in appearance.

Since the canister hangs down from the dispenser, it is necessary to have the dispenser engage the top of the canister securely to avoid having the canister accidentally dislodge from the dispenser. That requires a mechanical canister engagement mechanism which is capable of releasing the canister such that it can be removed from the dispenser when necessary for replacement or storage. However, given the need to securely engage the canister to retain the canister when fully loaded, the canister engagement mechanisms of the prior art dispensers are often difficult to release to permit the canister to be disengaged.

Those disadvantages are overcome by the structure of the present invention.

BRIEF SUMMARY OF THE INVENTION

In accordance with one aspect of the present invention, apparatus is provided for dispensing an aerosol product from a pressurized cylindrical canister of the type having an axis and a depressible stem. The apparatus includes a housing with a generally cylindrical body having a front, an axis and a recess adapted to receive at least a portion of the canister, with the stem situated substantially along the body axis. A stem actuator includes a part that is moveably mounted in the front of the body adjacent the canister stem. The actuator part has a channel. Means are provided for moving the actuator part relative to the body to depress the stem such that the product is released through actuator part channel.

The apparatus further includes means for engaging the canister within the recess. Preferably, the engaging means takes the form of means for automatically engaging the canister as it is received in the recess. It also includes means for releasing the engaging means.

The canister has a flange. The engaging means preferably takes the form of means for engaging the canister flange. The flange engaging means is moveably mounted on the body between a first position and a second position. It includes an inclined surface. The flange abuts the inclined surface as the canister is inserted into the body so as to move the flange engaging means toward the second position. Means are provided for urging the flange engaging means toward the first position, to engage the canister flange, when the canister is fully received within the recess.

Preferably, the flange engaging means is integral with the body. Specifically, the body has a side wall and the flange engaging means is integral with the side wall.

The front of the body defines an opening. The actuator part is moveably received within that opening.

The body also has a rear. The rear of the body defines an opening through which the canister is inserted.

The apparatus also has a handle. The actuator part moving means includes a trigger and means for connecting the trigger and the actuator part. The connecting means extends within said recess, between the canister and the side wall of the body. Preferably, the connecting means substantially surrounds the canister.

The connecting means defines an opening through which the flange engaging means extends.

Preferably, the connecting means and the actuator part are integral.

The canister engaging means includes a portion of the body side wall defined between a first arcuate slot in the body side wall and a second arcuate slot in the body side wall. The arcuate slots are oppositely facing. Preferably, one of the arcuate slots is larger than the other and the smaller one of the arcuate slots is at least partially situated within the larger.

Preferably, the handle has a substantially planar bottom end.

The canister stem has a nozzle. The actuator part includes a surface adapted to abut the nozzle. That surface may be a part of a recess in the actuator part adapted to receive the nozzle.

In accordance with another object of the present invention, a pistol-shaped product dispenser is provided including an open-ended body defining a recess adapted to receive a pressurized canister of the type having an axially extending depressible stem. A nose part is moveably mounted in the body and has a channel aligned with the axis of the canister. Means are provided for moving the nose part toward the canister, so as to depress stem and release the product through nose part channel.

The dispenser also includes means for automatically engaging the canister within the recess as it is inserted into the body.

The dispenser further includes means for releasing the means for automatically engaging the canister.

The dispenser further comprises trigger means connected to the nose part. Spring means are associated with the trigger means.

The dispenser further comprises a light source mounted on the body.

In accordance with another aspect of the present invention, pistol-shaped apparatus is provided for dispensing a product from a pressurized canister. The apparatus includes a body defining a recess for receiving the canister and a light source. Means are provided for mounting the light source on the body.

Preferably, the light source is a laser.

The body of the apparatus has an axis. The light source projects a light beam in a direction substantially parallel to the axis of the body.

BRIEF DESCRIPTION OF THE SEVERAL VIEWS OF DRAWINGS

To those, and to such other objects that may hereinafter appear, the present invention relates to an aerosol product dispenser as described in detail in the following specification and recited in the annex claims, taken together with the accompanying drawings, wherein like numerals refer to like parts, and wherein:

FIG. 11 is a partially cut away isometric view of the front portion of the dispenser;

FIG. 12 is a cross sectional view of the front portion of a second preferred embodiment of the present invention; and FIG. 13 is an isometric view of a third preferred embodiment of the present invention.

DETAILED DESCRIPTION OF THE INVENTION

Figure 1:
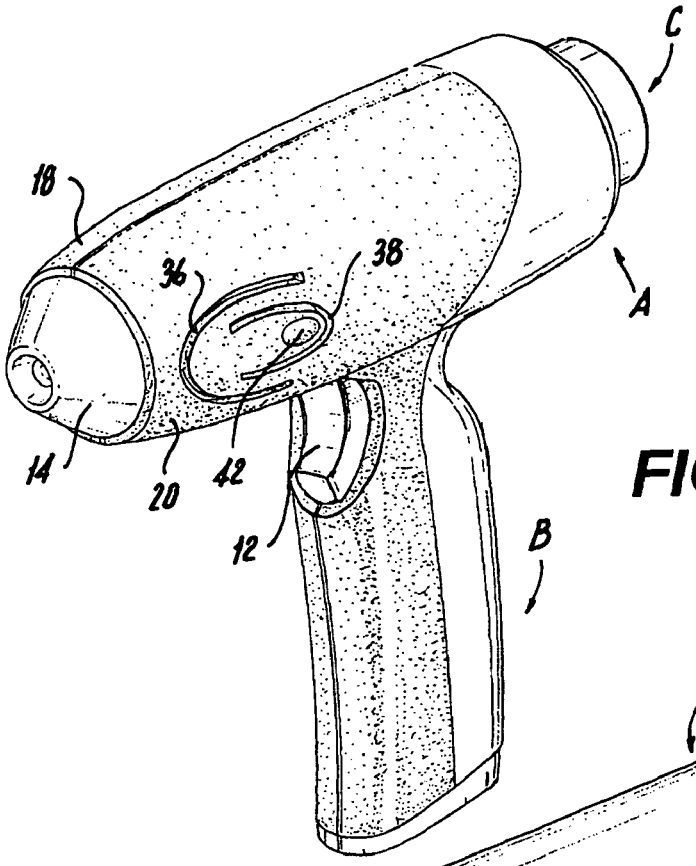
FIG. 1 is an isometric view of the dispenser of the present invention.
Figure 2:
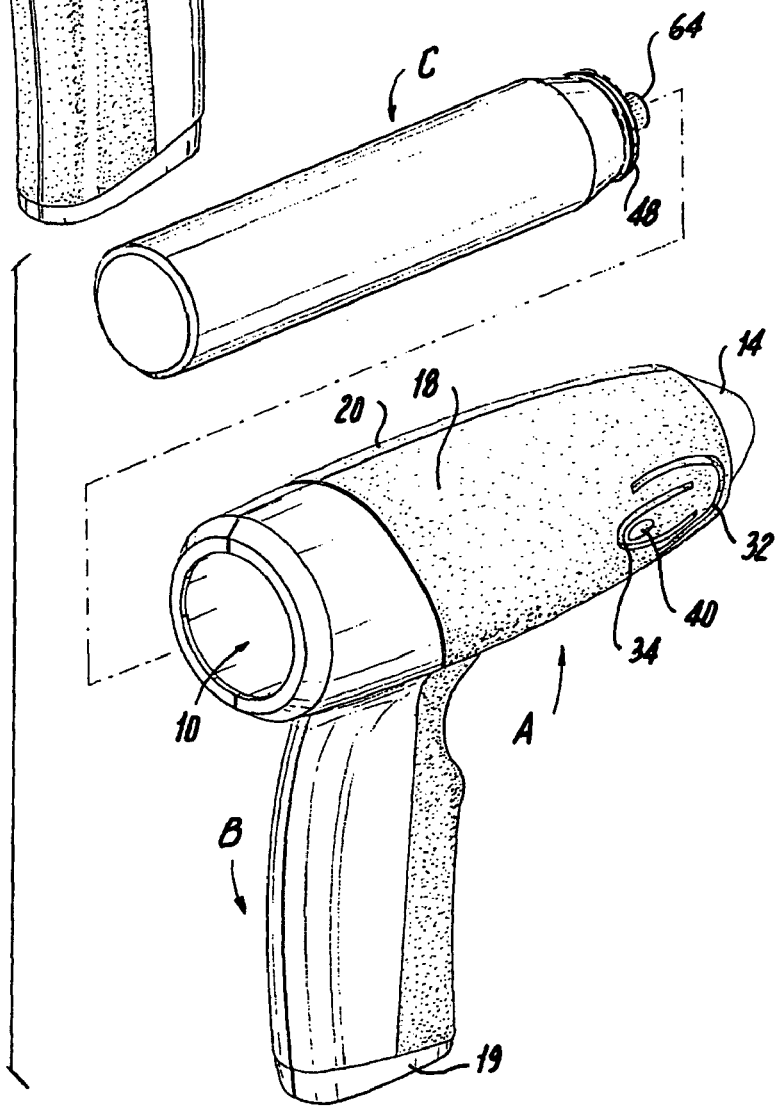
FIG. 2 is an exploded isometric view showing the dispenser of the present invention and the canister.
Figures 3, 4:
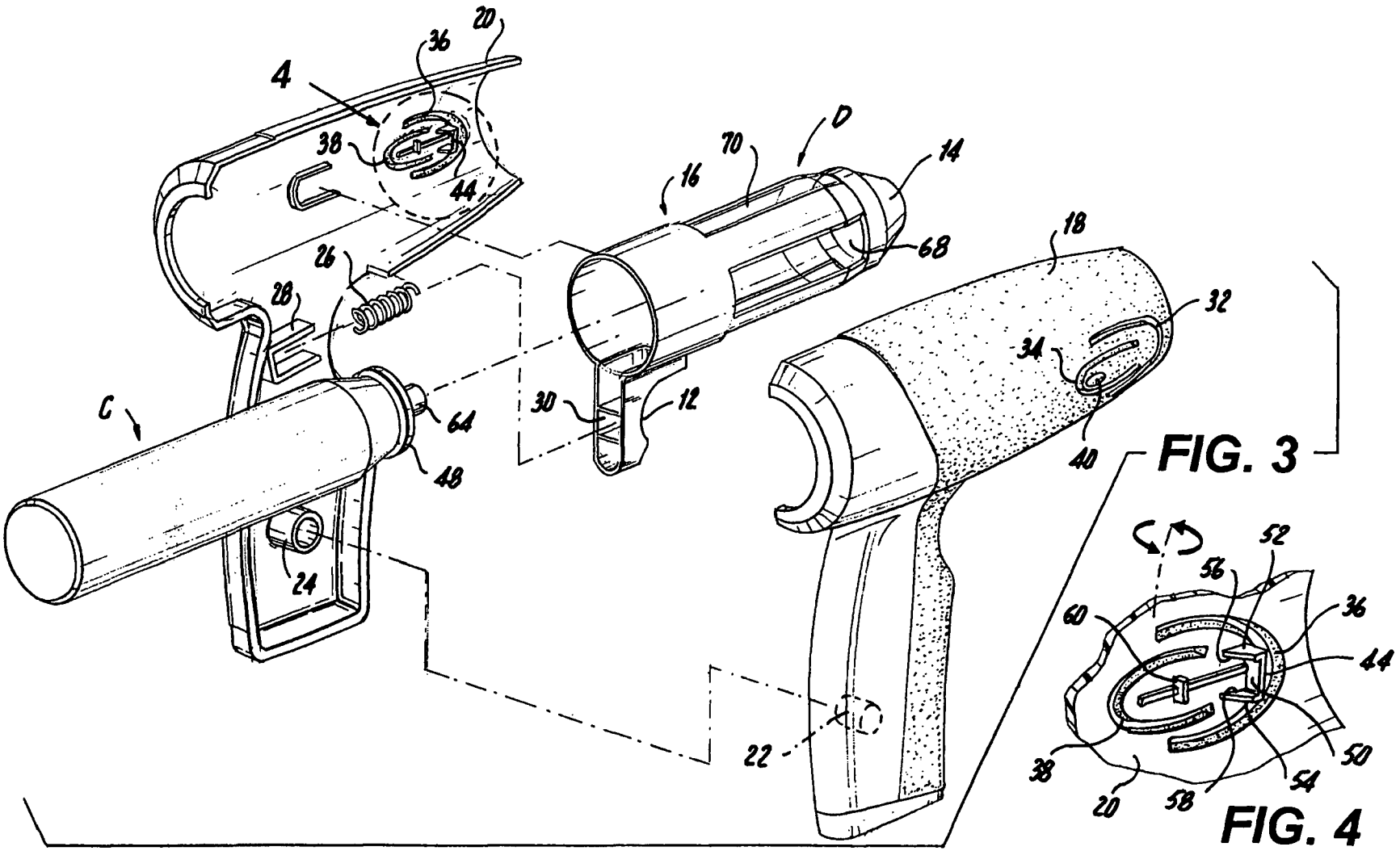
FIG. 3 is an exploded isometric view showing the internal mechanism of the dispenser.
FIG. 4 is an enlarged view of a section of the dispenser side wall within the dashed circle labeled "4" in FIG. 3.

As best seen from FIGS. 1, 2 and 3, the dispenser of the present invention has a generally pistol-like shaped housing, including a substantially cylindrical, hollow open-ended body, generally designated A, and a downwardly extending handle, generally designated B. A pressurized product-containing canister, generally designated C, is inserted into body A through a rear opening 10 therein, as seen in FIG. 2.

Situated within the housing is an actuator, generally designated D, which includes a trigger 12, a nose part 14 and a generally cylindrical hollow part 16 which connects trigger 12 to nose part 14. Preferably, trigger 12, nose part 14 and connecting part 16 are integral.

As is apparent from FIG. 3, the dispenser is formed of mirror image plastic ejection molded housing halves 18, 20, each having a body section and a handle section. The housing halves are joined together to form the housing by any conventional means, such as protrusion 22 and a boss 24 defining a protrusion-receiving channel, each of which extends inwardly from the interior surface of the handle section of a different one of the housing halves 18, 20. The housing halves 18, 20 may be permanently joined together by adhesive or the like. When joined, the housing halves 18, 20 enclose actuator D.

A spring 26 is received within the housing, between the housing wall and trigger 12. Specifically, extending inwardly from the interior wall of the housing is a three sided member 28 defining a channel into which one end of spring 26 is received. The other end of spring 26 is received in a recess 30 within trigger 12. Spring 26 urges actuator D toward the front of the housing, as is explained more fully below.

The forward portion of each of the housing halves 18, 20 has a pair of oppositely oriented, spaced arcuate slots 32, 34 and 36, 38, respectively. The forward arcuate slots 32 and 36 are larger than the rear arcuate slots 34 and 38. The rear arcuate slots 34 and 38 are at least partially received within the forward arcuate slots 32, 36 respectively. Located on the exterior surface of the housing halves, within the rear arcuate slots 34 and 38, are outwardly extending buttons 40 and 42, respectively.

Figure 6:
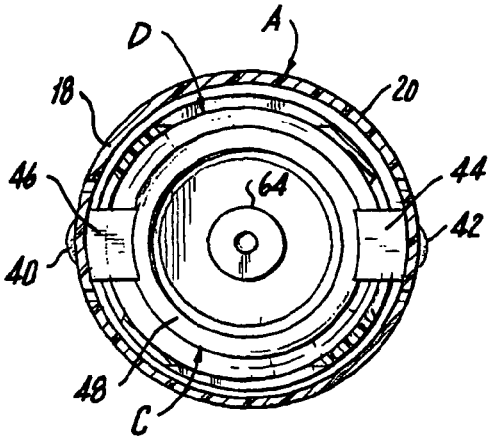
FIG. 6 is a cross sectional view taken along line 6-6 of FIG. 5 showing the flange engaging mechanism prior to the insertion of the canister.
Figure 7:
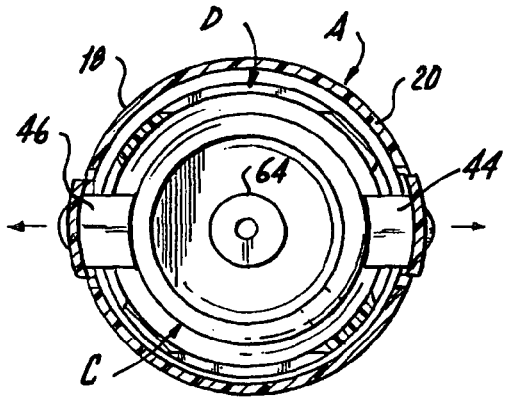
FIG. 7 is a view similar to FIG. 6 showing the flange engaging mechanism as the canister is inserted.
Figure 8:
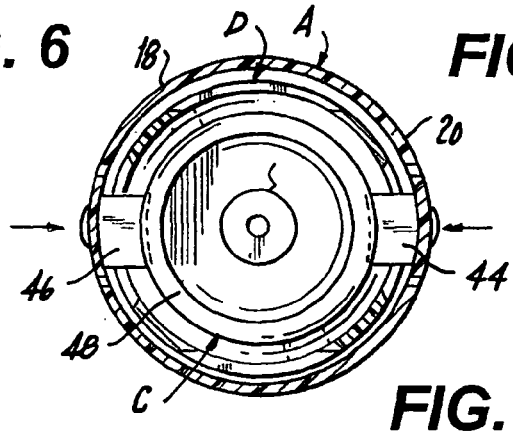
FIG. 8 is a view similar to FIG. 6 showing the flange engaging mechanism as it appears after the canister is fully inserted.

As can be seen in FIG. 4, which is an enlarged view of the portion of the interior surface of housing half 20, located immediately adjacent arcuate slot 36 is an inwardly extending protrusion 44. A mirror image protrusion 46 extends inwardly from the corresponding interior surface of housing half 18, as seen in FIGS. 6, 7 and 8. The function of protrusions 44 and 46 is to automatically engage the flange 48 of canister C, as the canister is inserted through opening 10 in the rear of body A, and to retain the canister in a fixed position relative to the housing, once the canister is fully inserted. The function of the arcuate slot pairs 32, 34 and 36, 38 is to cause the protrusions 44 and 46 to release the canister flange 48, to permit the canister to be removed from the dispenser body, when buttons 40 and 42 are pressed inwardly, toward each other.

The automatic engagement of the canister flange 48 by protrusions 44, 46, and the release thereof is made possible by the unique shape of protrusions 44 and 46 and by the flexibility of the housing side wall section of each housing half situated between each of the arcuate slot pairs. The shape of the protrusions 44, 46 is best seen from FIG. 4. Each protrusion is formed of a substantially planar front wall 50, which extends inwardly from and in a plane substantially perpendicular to the interior surface of the housing half, in a direction transverse to the axis of the body. Each protrusion also includes a pair of spaced side walls 52, 54, joined to the opposite edges of wall 50, respectively. The protrusion side walls extend from the interior surface of the side wall in planes substantially parallel to the axis of the housing body. The rearward facing edge 56, 58 of each of the protrusion side walls 52, 54, is inclined. The protrusions 44, 46 are mounted in opposing relation, on opposite housing body halves, and have substantially identical, but mirror image, configurations.

Figure 5:
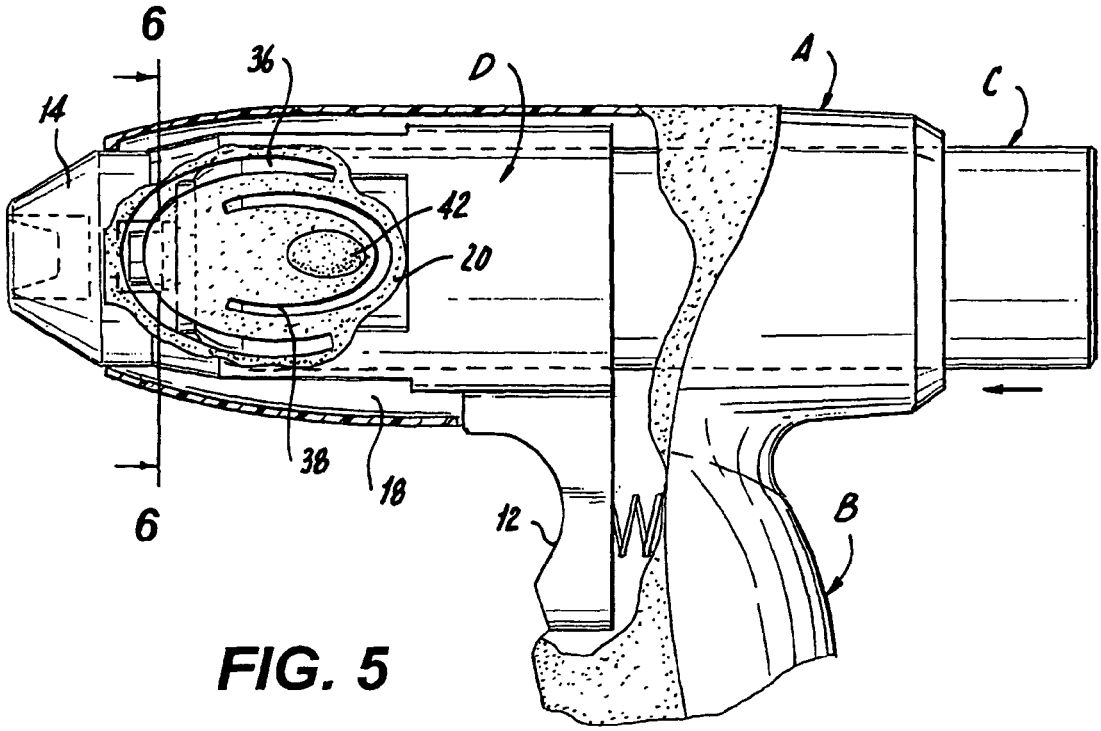
FIG. 5 is a partially cut away side view of the dispenser.

As the canister is inserted into the housing body, the flange abuts and bears against the inclined edges 56, 58 of the side walls of each protrusion, see FIG. 5. That causes the protrusions to "cam" out of the way of the flange, as the portion of the housing body side wall carrying each protrusion bows outwardly slightly, see FIG. 6, until the canister is fully inserted within the housing body. Once the flange reaches a position forward of the front wall 50 of each protrusion, the portions of each of the side walls carrying the protrusion cause that protrusion to move inwardly toward the other protrusion, back to its original position, such that each protrusion lodges in back of the flange, see FIG. 8. Once lodged behind the flange, the flange engaging protrusions retain the canister in a fixed position within the housing body. That permits the actuator D to depress the stem of the canister, without the canister being forced out the rear of the body.

In order to release the flange from protrusions 44 and 46, thereby permitting removal of the canister from the housing body, buttons 40 and 42 are depressed, moving the rear portion of the body side wall within the smaller arcuate slot in each housing half inwardly, toward the opposite side wall portion. This causes the flange engaging protrusions to move outwardly, as illustrated in FIG. 11, so as to release the flange. This outward movement is facilitated by a fulcrum member that bears against the canister wall.

Figure 9:
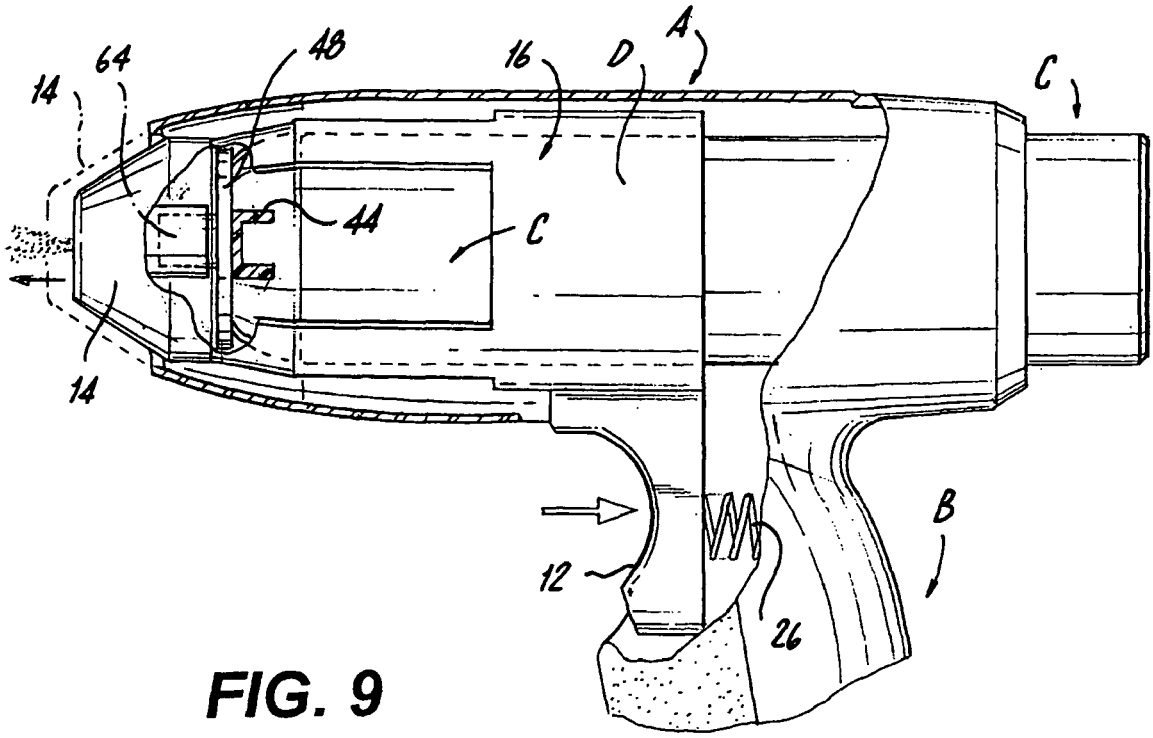
FIG. 9 is a partially cut away side view of the dispenser showing the trigger, nose part and connector.
Figure 10:
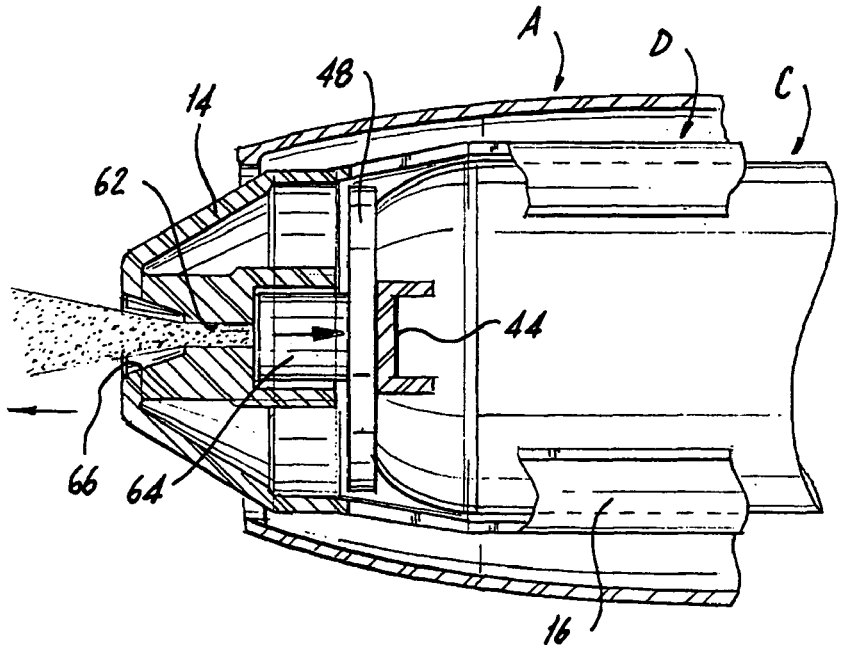
FIG. 10 is an enlarged cross sectional view of the front portion of the dispenser.

The depression of the canister stem to release the pressurized product is achieved by the rearward movement of the nose part 14. As best seen in FIGS. 9 and 10, nose part 14 has a central channel 62 that extends along the axis of the housing body, in alignment with the axis of the canister stem, and of a nozzle 64 mounted on the canister stem. The end 66 of channel 62 is flared outwardly to give the spray a conical shape.

The rearward movement of the nose part 14 is caused by the depression of trigger 12 against the action of spring 26. Since the trigger is connected to the nose part by connecting part 16, the trigger, nose part 14 and connecting part 16 all move as a unit. Accordingly, depressing the trigger depresses the nozzle and hence the canister stem, causing the pressurized product to be release through channel 62 in the nose part.

When the trigger is released, the nose part is returned to its original position (shown in phantom in FIG. 9) by the action of spring 26 and the of the canister stem. The nozzle and stem return to the normal positions, and the spray ceases.

It should be noted that connecting part 16 is cylindrically shaped and substantially surrounds the canister within the housing body. However, it is provided with elongated side openings 68, 70 such that actuator D can move within the housing body without interference from the flange engaging protrusions 44 and 46.

Preferably, the bottom end 19 of the handle is substantially planar. This permits the dispenser to stand upright on a horizontal surface.

FIG. 12 illustrates a second preferred embodiment of the present invention. In that embodiment, canister C' is supplied without a nozzle 64. However, a nozzle-like part 72 is fixed to, or formed integrally with, nose part 14'. Part 72 has a central channel designed to receive the canister stem therein, as illustrated. All other parts of the dispenser are identical in structure and function to those in the first preferred embodiment.

FIG. 13 illustrates a third preferred embodiment of the present invention. That embodiment is identical to the first preferred embodiment with the addition of a light source 74 mounted on top of the housing body A by a light source mounting bracket 76. The light source may be utilized for purposes of accurately aiming the spray. An on-off slide switch 78 is provided on the light source housing. The light source housing encloses a battery connected to the light source by the switch for energization purposes.

The light source may be a simple flashlight. However, a low energy laser, similar to a laser pointer, is preferred because the beam does not spread out as much and hence is better for aiming.

It should now be appreciated that the present invention relates to a pistol-shaped aerosol product dispenser in which the pressurized product-containing canister is received within the body of the dispenser with the stem aligned with the axis of the dispenser body such that the product is released from the dispenser in the direction of the axis of the canister, instead of perpendicular thereto. The dispenser includes an elegant mechanism for engaging, retaining and releasing the canister which has a minimum of moving parts. Embodiments are disclosed for use with canisters supplied with and without nozzles. An embodiment with a built in light source to facilitate aiming is also disclosed.

The dispenser has a very simple design and is formed of only three basic parts: two mirror image housing halves and a spring loaded actuator, designed to function together reliably for a long useful life. Further, it is well balanced, easy to use with one hand and aesthetically pleasing in appearance.

While only a limited number of preferred embodiments have been disclosed for purposes of illustration, it is obvious that many modifications and variations could be made thereto. It is intended to cover all of those modifications and variations which fall within the scope of the present invention, as defined by the following claims:

We claim:

1. Apparatus for dispensing an aerosol product from a pressurized cylindrical canister of the type having a depressible stem, said apparatus comprising a housing with a generally cylindrical body having a front, an axis and being adapted to receive at least a portion of the canister, with the stem situated substantially along said body axis, a stem actuator comprising a substantially cylindrical portion encircling the canister and a part moveably mounted in said front of said body adjacent the canister stem, said part having an channel, and means for moving said actuator relative to said body to depress the stem such that the product is released through said channel in said part.

2. The apparatus of claim 1 wherein said stem actuator has an opening further comprising means extending through said stem actuator opening for engaging the canister within said recess.

3. The apparatus of claim 2 further comprising means for releasing said canister engaging means.

4. Apparatus for dispensing an aerosol product from a pressurized cylindrical canister of the type having a depressible stem, said apparatus comprising a housing with a generally cylindrical body having a front, a wall, an axis and a recess adapted to receive at least a portion of the canister, with the stem situated substantially along said body axis, said wall having a flexible portion, a stem actuator comprising a part moveably mounted in said front of said body adjacent the canister stem, said part having an channel, and means for moving said actuator relative to said body to depress the stem such that the product is released through said part opening, further comprising means integral with and protruding from said flexible portion of said wall for automatically engaging the canister flange as the canister is received within said recess.

5. The apparatus of claim 1 wherein the canister has a flange and further comprising means for engaging the canister flange.

6. Apparatus for dispensing an aerosol product from a pressurized cylindrical canister of the type having a depressible stem, said apparatus comprising a housing with a generally cylindrical body having a front, a wall, an axis and a recess adapted to receive at least a portion of the canister, with the stem situated substantially along said body axis, a stem actuator comprising a part moveably mounted in said front of said body adjacent the canister stem, said part having an channel, and means for moving said actuator relative to said body to depress the stem such that the product is released through said part opening, wherein the canister has a flange, further comprising means for engaging the canister flange, said flange engaging means being moveably mounted on said body wall between a first position and a second position, and comprises an inclined surface, where the flange abuts said inclined surface to move said flange engaging means toward said second position as the canister is received within said recess, and means for urging said flange engaging means toward said first position, to engage the canister flange, when the canister is fully received within said recess.

7. The apparatus of claim 6 wherein said flange engaging means is integral with said body wall.

8. The apparatus of claim 6 wherein said body wall comprises a side wall and wherein said flange engaging means is integral with said side wall.

9. The apparatus of claim 1 wherein said front of said body defines an opening into which said actuator part is moveably received.

10. The apparatus of claim 1 wherein said body has a rear which defines an opening through which the canister is received.

11. The apparatus of claim 1 wherein said actuator part moving means comprises a trigger and means for connecting said trigger and said actuator part.

12. The apparatus of claim 11 wherein said connecting means extends within said recess, between the canister and said body.

13. The apparatus of claim 11 wherein the canister has a flange and further comprising flange engaging means mounted on said body and wherein said connecting means defines an opening through which said flange engaging means extends.

14. The apparatus of claim 11 wherein said connecting means and said actuator part are integral.

15. Apparatus for dispensing an aerosol product from a pressurized cylindrical canister of the type having a depressible stem, said apparatus comprising a housing with a generally cylindrical body having a front, an axis and a recess adapted to receive at least a portion of the canister, with the stem situated substantially along said body axis, a stem actuator comprising a part moveably mounted in said front of said body adjacent the canister stem, said part having an channel, and means for moving said actuator relative to said body to depress the stem such that the product is released through said part opening, means for engaging the canister within said recess, wherein said body comprises a wall and said canister engaging means comprises a portion of said wall defined between a first arcuate slot in said body wall and a second arcuate slot in said body wall.

16. The apparatus of claim 15 wherein said arcuate slots are oppositely facing.

17. The apparatus of claim 15 wherein one of said arcuate slots is larger than the other.

18. The apparatus of claim 15 wherein one of said arcuate slots is at least partially situated within the other.

19. The apparatus of claim 1 wherein said handle has a planar end.

20. The apparatus of claim 1 wherein the canister stem has a nozzle and wherein said actuator part comprises a surface adapted to abut the nozzle.

21. The apparatus of claim 1 wherein the canister stem has a nozzle and wherein said actuator part compresses a recess adapted to receive the nozzle.

22. The apparatus of claim 1 wherein said actuator part has a recess adapted to receive the stem of the canister.

23. A pistol-shaped product dispenser comprising an open-ended body defining a recess adapted to receive a pressurized canister of the type having an axially extending depressible stem, means for receiving the canister comprising a substantially cylindrical portion encircling the canister, and nose part moveably mounted in said body, said nose part having a channel aligned with the axis of the canister, and means for moving said nose part toward the canister, so as to depress the stem and release the product through said nose part channel.

24. The dispenser of claim 23 wherein the canister has a flange, said receiving means has an elongated opening and further comprising means for automatically engaging the canister flange within said recess, said canister engaging means extending through said opening.

25. The dispenser of claim 23 further comprising means for releasing said automatically engaging means.

26. The dispenser of claim 23 wherein said moving means comprises trigger means connected to said nose part.

27. The dispenser of claim 26 further comprising spring means associated with said trigger means.

28. The dispenser of claim 23 further comprising a light source mounted on said body.

29. The apparatus of claim 1 further comprising a light source and means for mounting said light source on said body.

30. The apparatus of claim 29 wherein said light source comprises a laser.

31. The apparatus of claim 29 wherein said body has an axis and said light source projects a light beam in a direction substantially parallel to said axis.

* * * * *